US009404639B2

(12) United States Patent
Bailey et al.

(10) Patent No.: US 9,404,639 B2
(45) Date of Patent: Aug. 2, 2016

(54) RECESSED LIGHTING ASSEMBLY WITH INTEGRATED INTERFACE MODULE

(71) Applicant: DMF, Inc., Carson, CA (US)

(72) Inventors: Michael D. Bailey, Long Beach, CA (US); Michael D. Moss, Hermosa Beach, CA (US)

(73) Assignee: DMF, Inc., Carson, CA (US)

( * ) Notice: Subject to any disclaimer, the term of this patent is extended or adjusted under 35 U.S.C. 154(b) by 272 days.

(21) Appl. No.: 14/247,149

(22) Filed: Apr. 7, 2014

(65) Prior Publication Data

US 2015/0276185 A1 Oct. 1, 2015

Related U.S. Application Data

(60) Provisional application No. 61/971,459, filed on Mar. 27, 2014.

(51) Int. Cl.

| | |
|---|---|
| ***F21V 13/04*** | (2006.01) |
| ***F21S 8/02*** | (2006.01) |
| *F21V 23/06* | (2006.01) |
| *F21Y 101/02* | (2006.01) |
| *F21Y 105/00* | (2016.01) |
| *F21V 29/74* | (2015.01) |
| *F21V 29/85* | (2015.01) |

(52) U.S. Cl.

CPC ..... *F21V 13/04* (2013.01); *F21S 8/024* (2013.01); *F21S 8/026* (2013.01); *F21V 23/06* (2013.01); *F21V 29/74* (2015.01); *F21V 29/85* (2015.01); *F21Y 2101/02* (2013.01); *F21Y 2105/008* (2013.01)

(58) Field of Classification Search

CPC ..... F21V 13/04; F21S 8/024; F21S 8/026

See application file for complete search history.

(56) References Cited

U.S. PATENT DOCUMENTS

| | | | |
|---|---|---|---|
| 4,729,080 | A | 3/1988 | Fremont et al. |
| 5,944,412 | A | 8/1999 | Janos et al. |
| 6,174,076 | B1 | 1/2001 | Petrakis et al. |
| 7,959,332 | B2 | 6/2011 | Tickner et al. |

(Continued)

FOREIGN PATENT DOCUMENTS

| | | |
|---|---|---|
| CA | 2815067 | 11/2013 |

OTHER PUBLICATIONS

DMF, INC. "dmfLighting: LED Recessed Lighting Solutions." Info sheets (Mar. 19, 2012). 4 pages.

(Continued)

*Primary Examiner* — Mary Ellen Bowman

(74) *Attorney, Agent, or Firm* — Blakely Sokoloff Taylor & Zafman LLP

(57) ABSTRACT

A compact recessed lighting system is provided. The lighting system includes a light source module, a heat sink, a lens, a set of electrical contacts, and a set of trims. Each of these elements of the lighting system may be coupled to an integrated interface module. The recessed lighting system provides a reduced set of components while ensuring adaptability and easy installation into a structure. In particular, by including an integrated interface module that allows the light source module, the set of trims, the lens, and the heat sink to be easily replaced with minimal tools and minimal fasteners, the recessed lighting system described herein provides a more efficient and user friendly design in comparison to traditional systems.

20 Claims, 11 Drawing Sheets

(56) References Cited

U.S. PATENT DOCUMENTS

| | | | | |
|---|---|---|---|---|
| 8,142,057 | B2 | 3/2012 | Roos et al. | |
| 8,277,090 | B2 | 10/2012 | Fryzek et al. | |
| 8,403,533 | B1 * | 3/2013 | Paulsel | F21S 8/026 362/249.02 |
| 8,430,533 | B1 * | 4/2013 | Blalock | F21V 19/003 362/294 |
| 8,550,669 | B2 | 10/2013 | Macwan et al. | |
| 2011/0068687 | A1 * | 3/2011 | Takahasi | F21K 9/1355 315/35 |
| 2011/0069499 | A1 * | 3/2011 | Trott | F21S 8/026 362/365 |
| 2011/0216534 | A1 | 9/2011 | Tickner et al. | |
| 2012/0287625 | A1 * | 11/2012 | Macwan | F21V 29/004 362/235 |
| 2013/0258677 | A1 * | 10/2013 | Fryzek | F21V 29/004 362/326 |

OTHER PUBLICATIONS

*HALO LED H4 H7 Collection, SustainabLEDesign*, Cooper Lighting (Mar. 28, 2012). 52 pages.

*LED Module ML706x*. Cooper Lighting. (Oct. 20, 2009). 4 pages.

* cited by examiner

RECESSED LIGHTING ASSEMBLY WITH INTEGRATED INTERFACE MODULE

RELATED MATTERS

This application claims the benefit of the earlier filing date of U.S. provisional application No. 61/971,459 filed Mar. 27, 2014.

FIELD

An embodiment of the invention relates to a compact recessed lighting system that includes an integrated interface module that allows for easy connections and interchangeability with associated parts of the recessed lighting system. Other embodiments are also described.

BACKGROUND

Recessed lighting systems are typically installed or mounted into an opening in a ceiling or a wall. Recessed lighting systems generally consist of various components of different shapes and sizes. For example, different styles of trims, reflectors, and light source modules may be used to accommodate different needs of consumers.

Although current recessed lighting systems come in a variety of shapes and sizes, switching between different components can be tedious and cumbersome. In particular, current recessed lighting systems require the removal of numerous screws and fasteners to change a single component of the system. Further, changing a single component, such as a trim, may require replacement of other components in the system so that the proper connections are established and efficient distribution of light may be accomplished. Thus, there is a need for a recessed lighting system that enables efficient interchangeability between different components.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
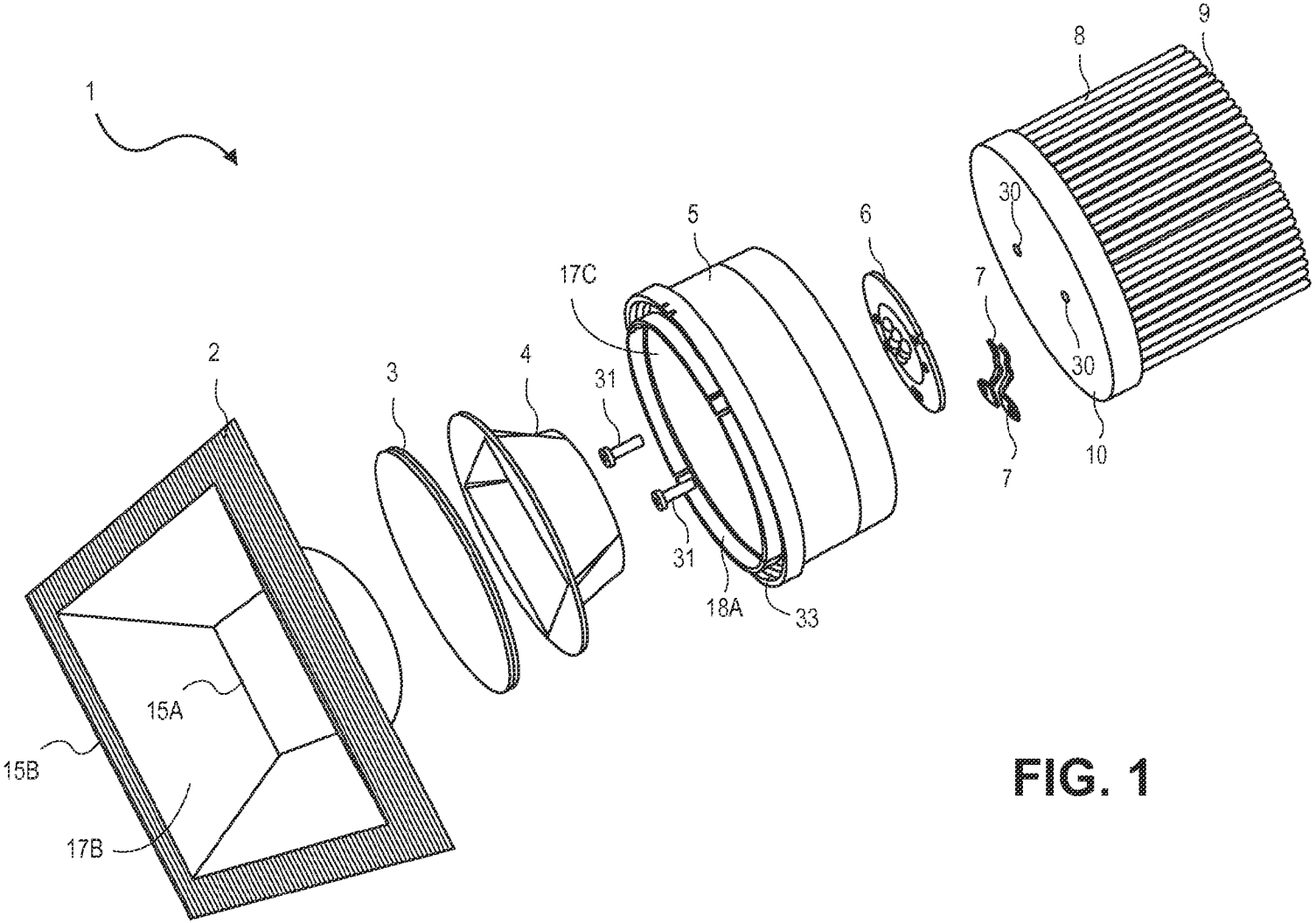
FIG. 1 shows an exploded view of a recessed lighting system according to one embodiment.

FIG. 1 shows an exploded view of a recessed lighting system 1. The recessed lighting system 1 may include a trim 2, a lens 3, a reflector insert 4, an integrated interface module 5, a light source module 6, a set of electrical contacts 7, and a heat sink 8. Although shown in FIG. 1 with a single trim 2, lens 3, reflector insert 4, light source module 6, and heat sink 8, in other embodiments different styles and/or sizes of trims 2, lenses 3, reflector inserts 4, light source modules 6, and/or heat sinks 8 may be used. As will be described in further detail below, the recessed lighting system 1 has a more efficient design that reduces the number of components and increases the efficiency of changing/replacing such components in comparison to traditional lighting systems. Each element of the recessed lighting system 1 will be described by way of example below.

Figure 2A:
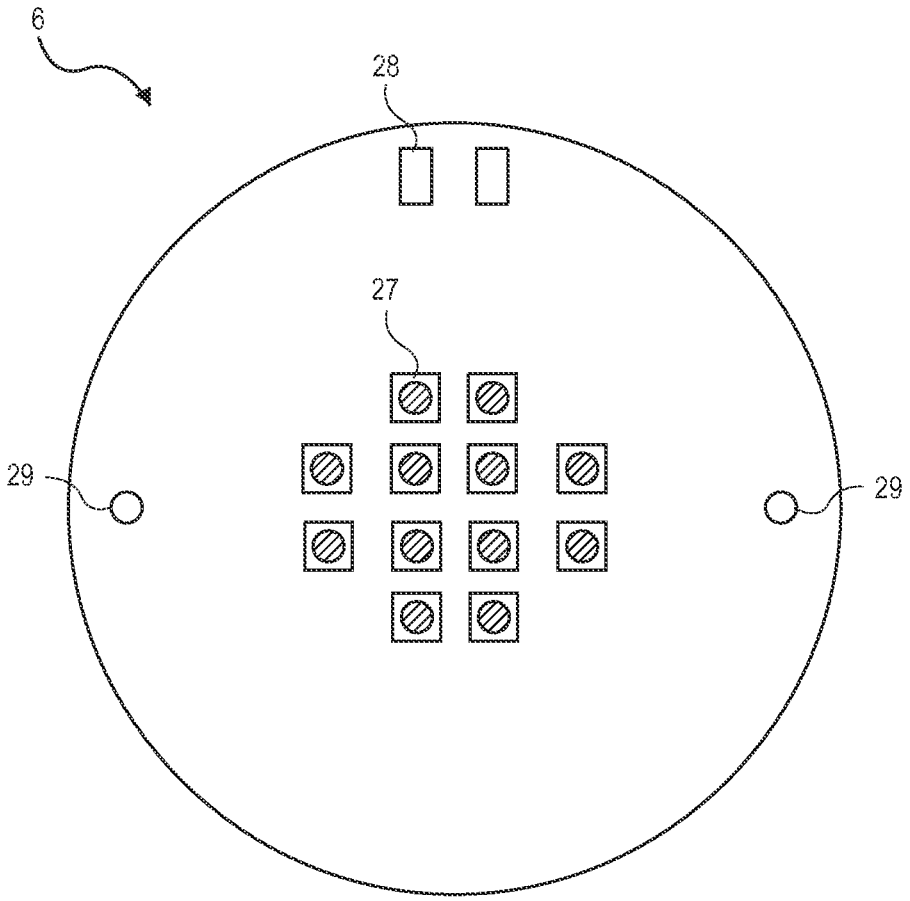
FIG. 2A shows an overhead view of a light source module according to one embodiment.
Figure 2B:
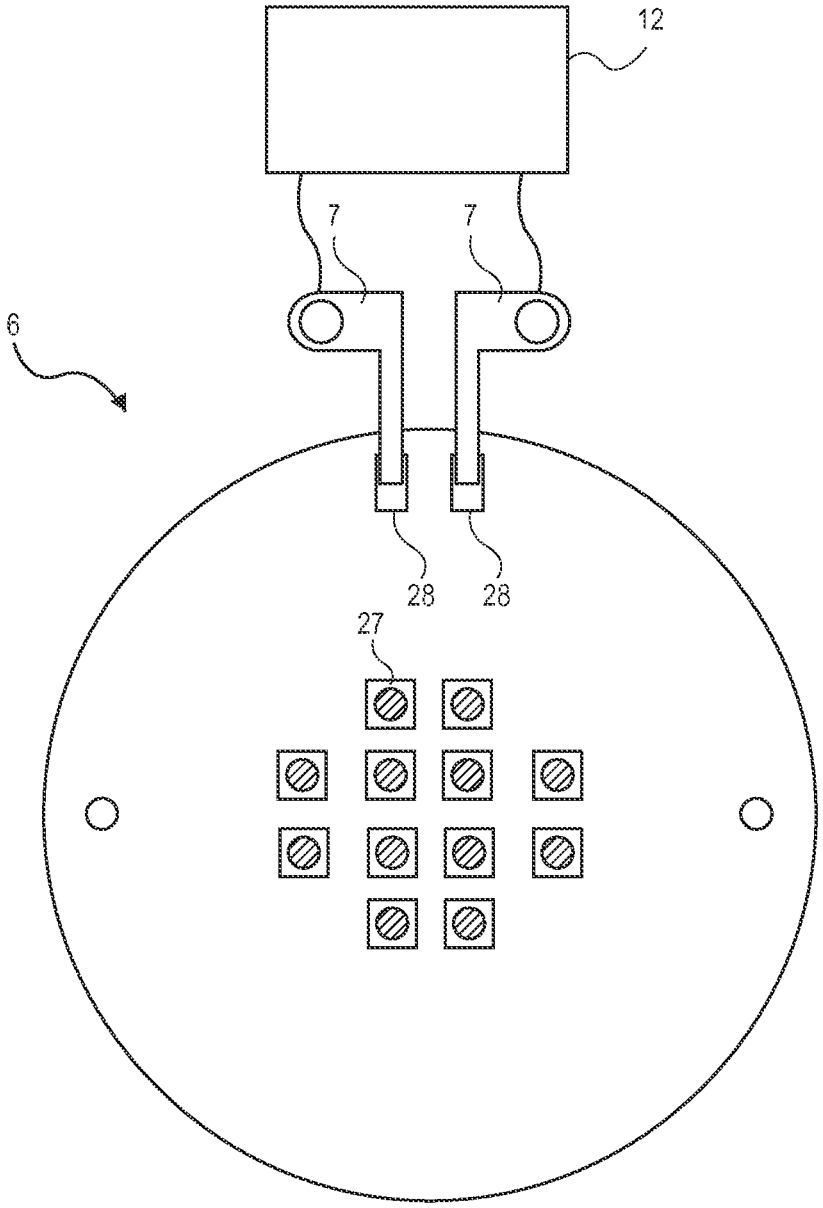
FIG. 2B shows an overhead view of the light source module with a set of electrical contacts according to one embodiment.

FIG. 2A shows an overhead view of the light source module 6 according to one embodiment. As shown in FIG. 2A, the light source module 6 may be any electro-optical device or combination of devices for emitting light. For example, the light source module 6 may have as a single light source 27 a light emitting diode (LED), organic light-emitting diode (OLED), or polymer light-emitting diode (PLED) installed on a carrier structure as shown (e.g., a printed circuit board or flex circuit). In some embodiments, the light source module 6 may have multiple light sources 27 (e.g., LEDs, OLEDs, and/or PLEDs) as shown in FIG. 2A. The light source module 6 receives electricity from a power source 12 as shown in FIG. 2B such that the light source module 6 may emit a controlled beam of light into a room or a surrounding area. In one embodiment, the light source module 6 may include a set of electrical leads 28 positioned in its carrier structure, for receiving electricity from the power source 12 via the electrical contacts 7 as shown in FIG. 2B. The electrical leads 28 of the light source module 6 may be soldering points that are traditionally coupling areas for wires that are directly soldered to the light source module 6 and directly connect the light source module 6 with the power source 12. The power source 12 (which may include an electronic power supply circuit) is designed to ensure that the appropriate voltage and current are fed to the light source module 6 to enable the emission of light by the one or more light sources 27 within the light source module 6. In these embodiments, the power source 12 may be attached or fixed to a junction box or another structure (not shown) of the recessed lighting system 1, apart from the heat sink 8, the integrated interface module 5, the light source module 6, and the trim 2. In contrast to traditional lighting systems that receive electricity through wires directly connected between the light source and the power source, the light source module 6 receives electricity from the power source 12 via the electrical contacts 7. As will be described further below, the electrical contacts 7 make contact with the electrical leads 28, but do not maintain a permanent or rigid connection (like a solder joint.) Accordingly, the light source module 6 may be easily replaced without the need to cut wires or de-solder applied connections.

Figure 3:
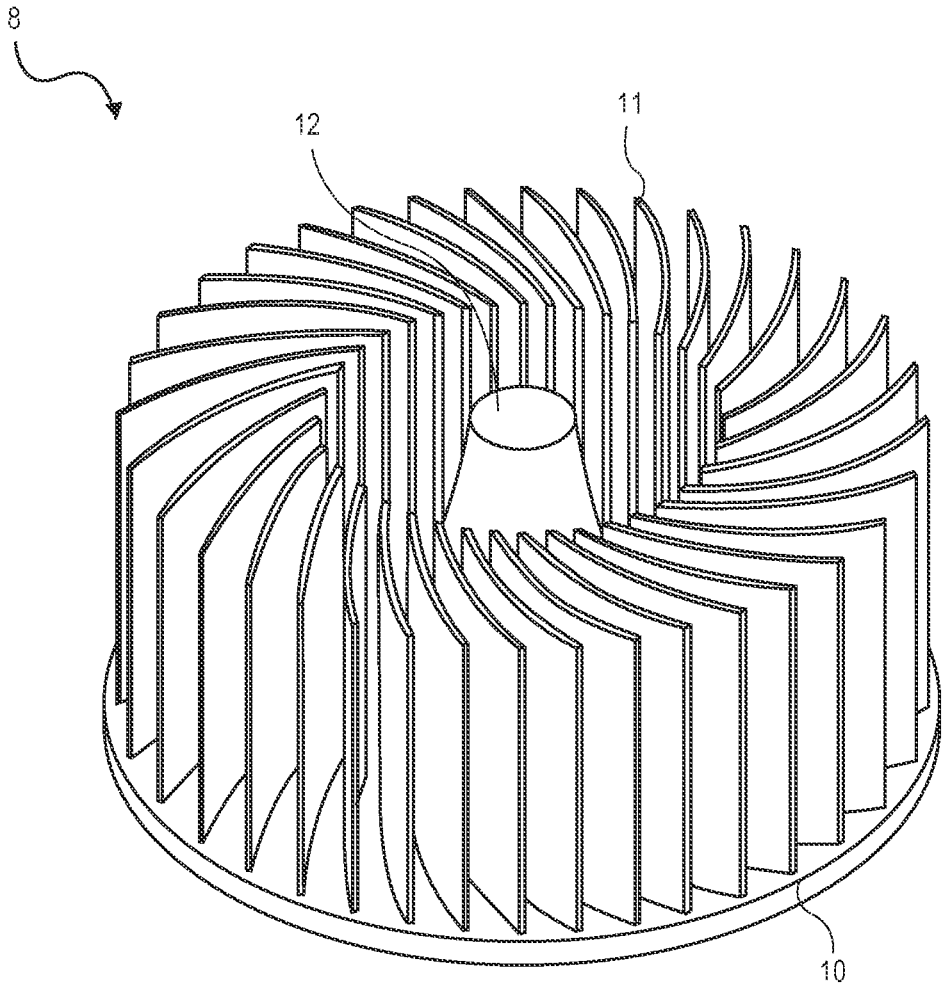
FIG. 3 shows an example heat sink according to another embodiment.

In one embodiment, the recessed lighting system 1 includes one or more heat sinks 8 to dissipate heat generated by the light source module 6. As shown in FIG. 1, the heat sink 8 may include a set of pins or strands 9 protruding from and/or affixed to a heat sink base 10. However, in other embodiments, the heat sink 8 may have a different shape or design. For example, FIG. 3 shows an example heat sink 8 according to another embodiment. In this embodiment, a set of fins 11 are coupled to a heat sink base 10, and the power source 12 for powering the light source module 6 may be inserted within a center section of the set of fins 11. In this example embodiment, the heat sink 8 may dissipate heat from both the light source module 6 and the power source 12. In other embodiments, the power source 12 may be positioned separately from the heat sink 8 and other components of the recessed lighting system 1 shown in FIG. 1. For example, the power source 12 may be located in a junction box (not shown) or a frame (not shown), which supports the recessed lighting system 1 in a hole or structure in which the recessed lighting system 1 is installed. Although the heat sinks 8 shown in FIG. 1 and FIG. 3 are shown as passive components that cool the light source module 6 by dissipating heat into the surrounding air, active heat sinks (e.g., fans) may also be used.

The heat sink 8 may be composed of any thermally conductive material. For example, the heat sink 8 may be made of aluminium alloys, copper, copper-tungsten pseudoalloy, AlSiC (silicon carbide in aluminium matrix), Dymalloy (diamond in copper-silver alloy matrix), E-Material (beryllium oxide in beryllium matrix), and/or thermally conductive plastics or ceramics.

In one embodiment, the recessed lighting system 1 may include a lens 3. The lens 3 may be formed to converge, diverge, or otherwise modify (e.g., filter) light emitted by the light source module 6. The lens 3 may be a simple lens comprised of a single optical element or it may be a compound lens comprised of an array of simple lenses (elements) with a common axis. In one embodiment, the lens 3 also provides a protective barrier for the light source module 6 and shields the light source module 6 from moisture or inclement weather. The lens 3 may also assist in the diffusion of light and increase the uniformity of light over the surface of the recessed lighting system 1. The lens 3 may be made of any at least partially transparent material, including glass and hard plastics. In one embodiment, the lens 3 and the trim 2 are contained in a single indivisible unit to work in conjunction to focus and adjust light emitted by the light source module 6. In other embodiments, the lens 3 and the trim 2 are separate, divisible elements as shown in FIG. 1. In these embodiments, the lens 3 may be removably coupled to the integrated interface module 5 as will be described in greater detail below.

In one embodiment, the recessed lighting system 1 may include one or more trims 2. The trims 2 may be interchangeable such that multiple trims 2 may be separately used with the recessed lighting system 1. For example, a first trim 2 may be coupled to the integrated interface module 5. Thereafter, this first trim 2 may be detached from the integrated interface module 5 without the use of tools and a second trim 2 may be installed. The trims 2 serve the primary purpose of covering the exposed edge of the ceiling or wall where a hole is formed in which the recessed lighting system 1 resides, while still allowing light from the light source module 6 to be emitted into a room through its upper and lower openings 15A and 15B. In doing so, the trims 2 help the recessed lighting system 1 appear seamlessly integrated into the ceiling or wall.

The trims 2 may be made of any material or set of materials. For example, the trims 2 may be made of one or more of aluminum plastic polymers, alloys, copper, copper-tungsten pseudoalloy, AlSiC (silicon carbide in aluminum matrix), Dymalloy (diamond in copper-silver alloy matrix), and E-Material (beryllium oxide in beryllium matrix).

In one embodiment, the trims 2 are capable of coupling to the integrated interface module 5 while in other embodiments the trims 2 are capable of coupling to one or more other components of the recessed lighting system 1. The trims 2 may couple to the integrated interface module 5 using any connecting mechanism, including resins, clips, screws, bolts, or clamps. In one embodiment, the trims 2 may include a ridge 14 for coupling to corresponding elements of the integrated interface module 5 as shown in FIGS. 4A, 4B, and 4D and as will be described in greater detail below.

As noted above, the recessed lighting system 1 may include multiple trims 2 of different shapes and sizes. Each of these differently shaped and/or sized trims 2 may be capable of being coupled to the same integrated interface module 5. The size and design of the trims 2 installed with the recessed lighting system 1 may depend on the size of the hole in which the recessed lighting system 1 has been fitted and that the trim 2 must conceal, as well as the aesthetic decisions of the consumer. In these embodiments, the ridge 14 of each of the trims 2 may be uniform while the other elements of the trims 2 may be distinct.

Figure 4B:
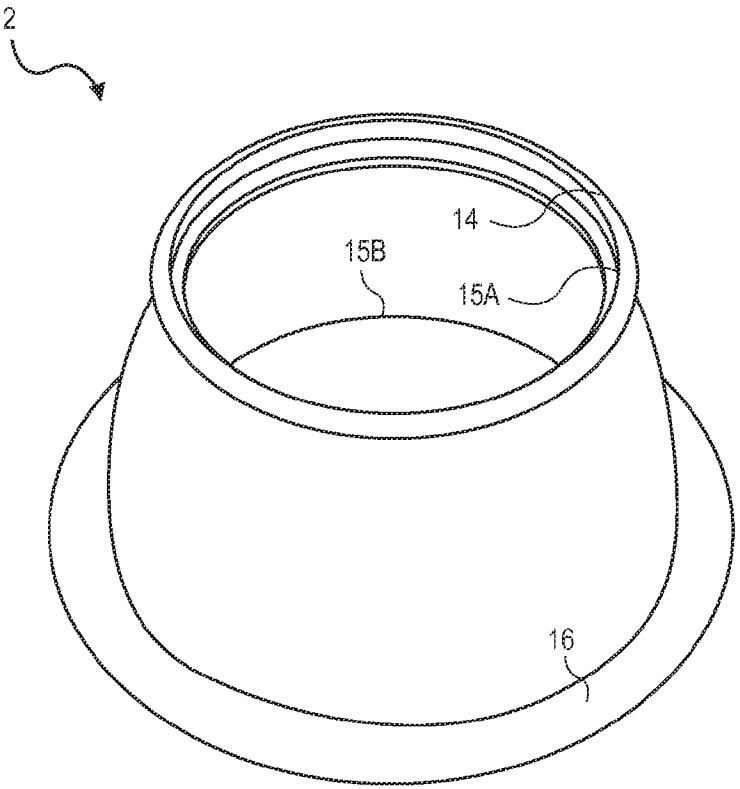
FIG. 4B shows a view of the first example trim with a lower opening of the first example trim in the foreground.
Figure 4A:
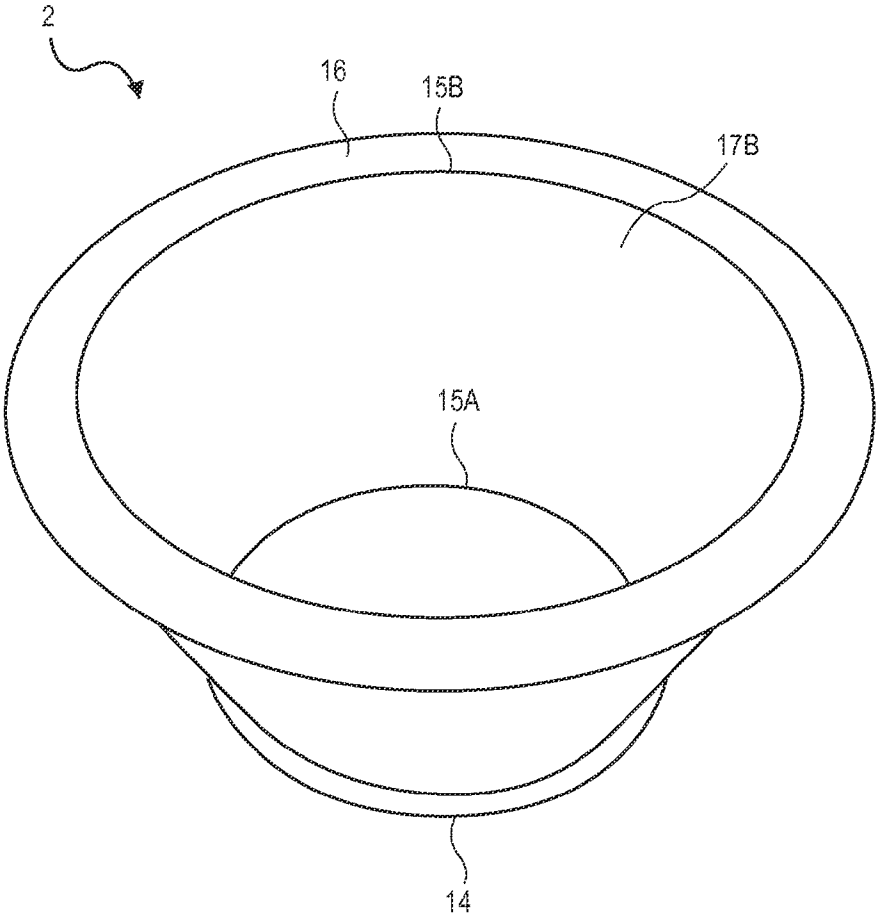
FIG. 4A shows a view of a first example trim with an upper opening of the first example trim in the foreground.
Figure 4D:
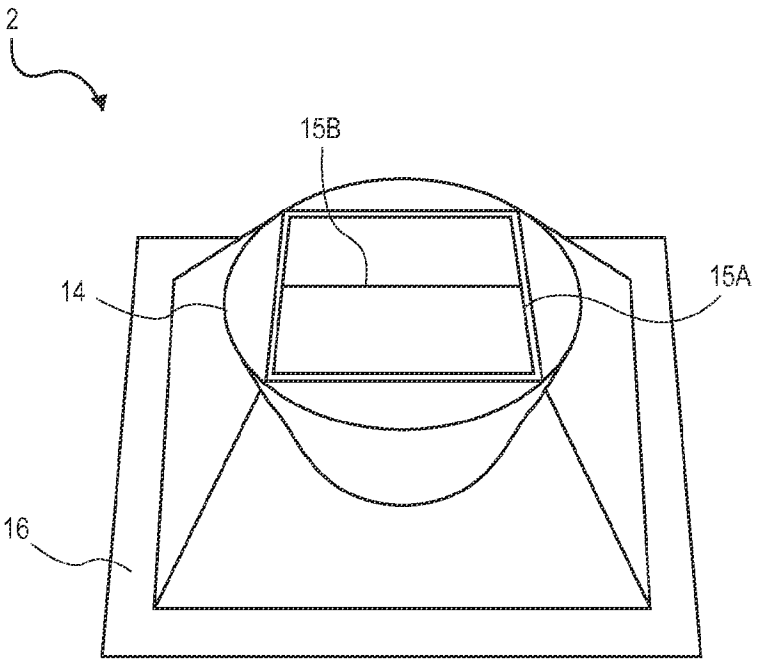
FIG. 4D shows a view of the second example trim with a lower opening of the first example trim in the foreground.
Figure 4C:
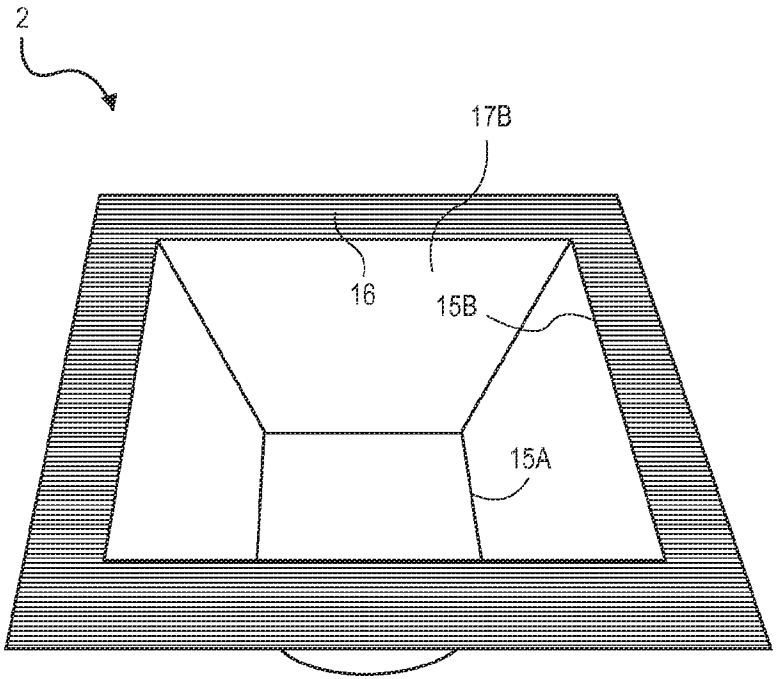
FIG. 4C shows a view of a second example trim with an upper opening of the first example trim in the foreground.

FIGS. 4A and 4B show views of a first example trim 2 according to one embodiment. In particular, FIG. 4B shows a view of the first example trim 2 with an upper opening 15A in the foreground and FIG. 4A shows a view of the first example trim 2 with the lower opening 15B in the foreground. The upper opening 15A may be surrounded with the ridge 14 for coupling with the integrated interface module 5 while the lower opening 15B may be surrounded by a flange 16 for concealing the wall or ceiling hole in which the recessed lighting system 1 is installed. As shown in FIGS. 4A and 4B, the upper and lower openings 15A and 15B are both round/circular and the flange 16 of the trim 2 is also round/circular. Turning now to FIGS. 4C and 4D, a second example trim 2 is shown. In contrast to the first example trim 2 in FIGS. 4A and 4B, the second example trim 2 in FIGS. 4C and 4D has primarily square/rectangular upper and lower openings 15A and 15B and a square/rectangular flange 16. Each of the trims 2 shown in FIG. 4A-4D may be similarly attached to the integrated interface module 5 using a similar ridge 14 as will be described in greater detail below. Accordingly, the recessed lighting system 1 may be easily adaptable to function with different style trims 2 based on the preferences and needs of the consumer.

Figure 9B:
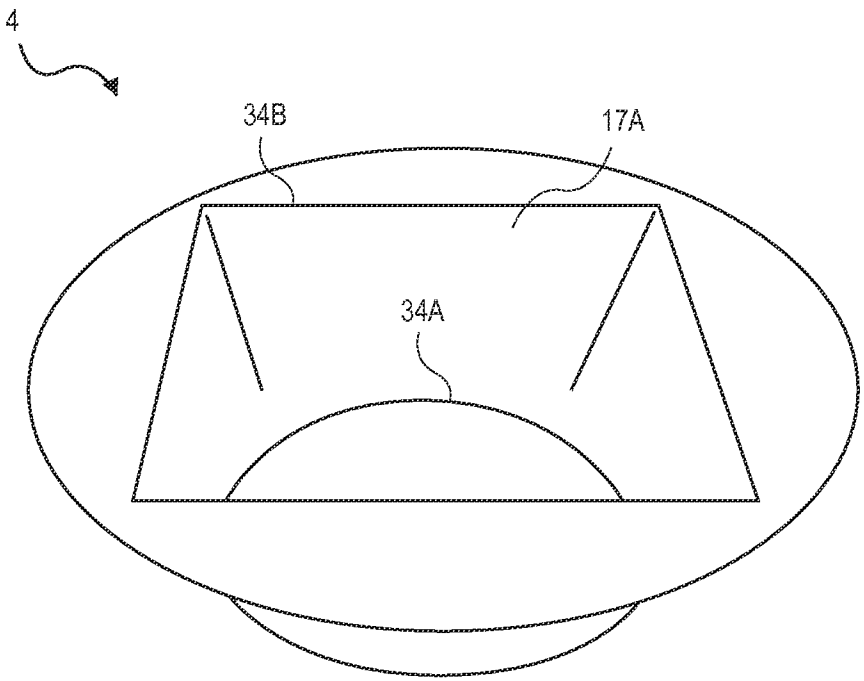
FIG. 9B shows a view of the reflector insert with a square lower opening of the insert in the foreground.
Figure 9A:
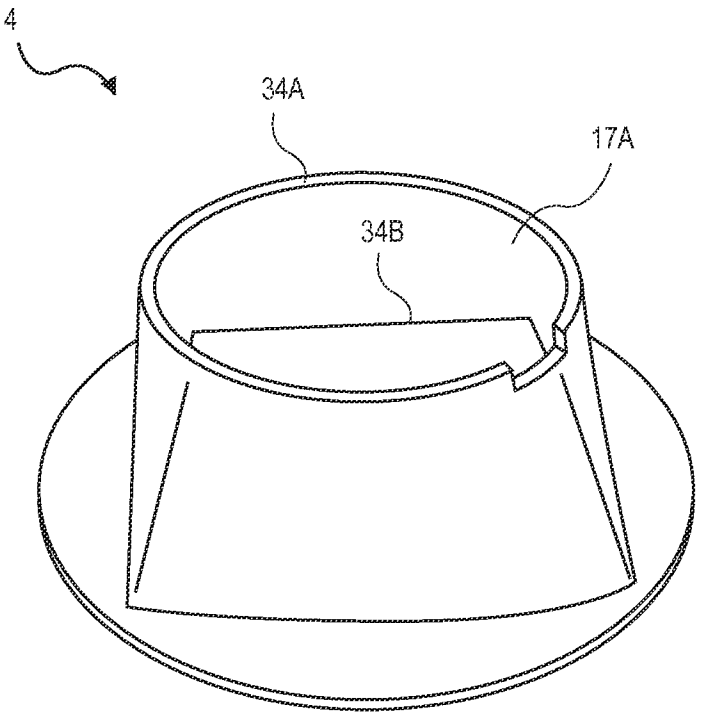
FIG. 9A shows a view of a reflector insert with a round upper opening of the insert in the foreground.

In some embodiments, the reflector insert 4 may be used to bridge differences in size or shape between the integrated interface module 5 and the trim 2. However, the use of the reflector insert 4 may be optional and, as noted above, may be only used when the shapes and/or sizes of the integrated interface module 5 and the trim 2 do not align or do not allow connection, and/or provide a non-ideal connection, which allows the leakage of light. In particular, as shown in the examples of FIGS. 1, 4C, and 4D, the trim 2 includes a square upper opening 15A while the front face 18A of the integrated interface module 5 is round. To accommodate for these differences in shape, the reflector insert 4 may be used, as shown in FIGS. 9A and 9B, which includes 1) a round upper opening 34A to accommodate the round front face 18A of the integrated interface module 5 and/or to accommodate the round light source module 6 and 2) a square lower opening 34B to accommodate the square upper opening 15A of the trim 2. FIGS. 9A and 9B show views of an example reflector insert 4 according to the example embodiment described above. In particular, FIG. 9A shows a view of the reflector insert 4 with a round upper opening 34A in the foreground and FIG. 9B shows a view of the reflector insert 4 with a square lower opening 34B in the foreground. The reflector insert 4 may be optionally used in the recessed lighting system 1 to accommodate for differences in integrated interface module 5 and trim 2 designs as described above. By accommodating for these differences, leakages or losses of light may be avoided. In particular, light which would leak out into a periphery of or behind the trim 2 is now properly focused in front of the trim 2, through the upper and lower openings 15A and 15B of the trim 2 and out into a room. Although described in relation to round and square shapes, in other embodiments the reflector insert 4 may accommodate for any set of different shapes or sizes, including triangular shapes, rectangular shapes, elliptical shapes, star shapes, hexagonal shapes, etc.

In one embodiment, the reflector insert 4 may be held within the integrated interface module 5 through the use of the lens 2, which may be coupled to the integrated interface module as will be described in greater detail below. As shown in FIGS. 9A and 9B, a cavity 17A may be formed between the upper opening 34A and the lower opening 34B. The cavity 17A may be shaped to focus light from the light source module 6 through the trim 2 and/or the lens 3 and into a room in which the recessed lighting system 1 is installed. The cavity 17A may form a frusto conical shape; however, in other embodiments the cavity 17A may be in any other shape that facilitates the focusing of light (e.g., frusto pyramidal). In one embodiment, the front surfaces of the walls of the cavity 17A may be coated with or may include one or more reflecting elements that assist in the adjustment of light emitted by the light source module 6. For example, the cavity 17A may be coated with a shiny enamel or include one or more mirrors or retroreflectors or a microcellular polyethylene terephthalate (MCPET) material to adjust the focus of light emitted by the light source module 6. In other embodiments, the cavity 17A may include various other optic elements to assist in the focusing of light emitted by the light source module 6.

Returning to the trims 2, in addition to concealing a hole in which the recessed lighting system 1 is installed, the trims 2 may be used to focus light generated by the light source module 6. For example, the trims 2, as shown in FIGS. 1, 4A, and 4C, may include a cavity 17B that is formed between the upper and lower openings 15A and 15B. The cavity 17B may be shaped to direct light. For example, similar to the cavity 17A, the cavity 17B may form a frusto conical shape such that the cavity narrows from the lower opening 15B towards the upper opening 15A. However, in other embodiments the cavity 17B may be in any other shape that facilitates the focusing of light (e.g., frusto pyramidal). In one embodiment, the walls of the cavity 17B may be coated with or may include one or more reflecting elements that assist in the adjustment of light emitted by the light source module 6. For example, the cavity 17B may be coated with a shiny enamel or include one or more mirrors or retroreflectors or a microcellular polyethylene terephthalate (MCPET) material to adjust the focus of light emitted by the light module 6. In other embodiments, the cavity 17B may include various other optic elements to assist in the focusing of light emitted by the light source module 6.

Turning now to the integrated interface module 5, the techniques and devices for combining and/or coupling each of the components of the recessed lighting system 1 together will now be described. As will be discussed in greater detail below, the integrated interface module 5 allows components of the recessed lighting system 1 to be combined while reducing the number of fasteners needed to do so, and the overall complexity of changing parts or installing the recessed lighting system 1 into a structure may be simplified.

Figure 5:
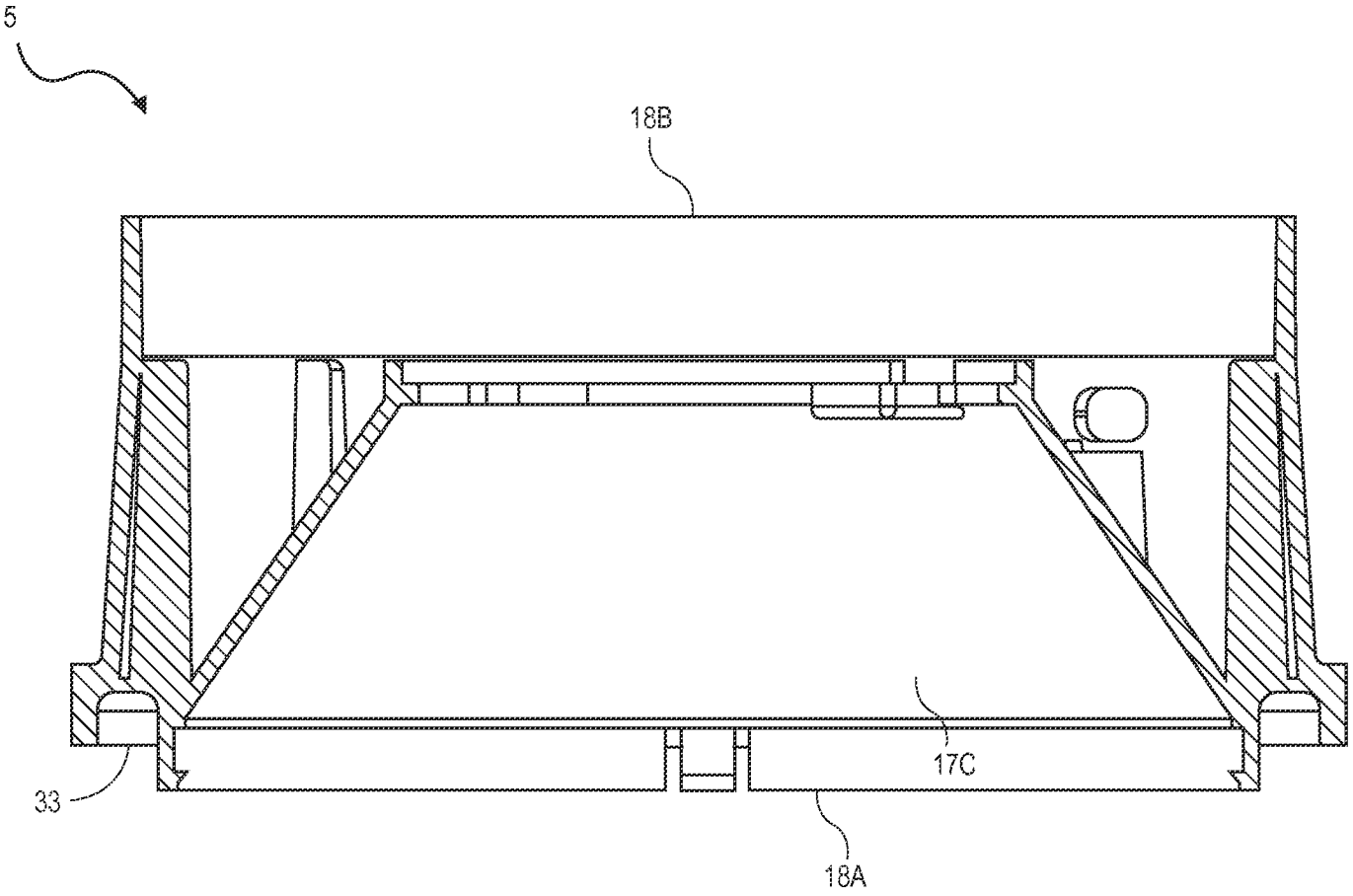
FIG. 5 shows a cutaway side view of the integrated interface module according to one embodiment.

The integrated interface module 5 may be a shell and/or enclosure that 1) prevents the exposure of heat from the light source module 6 to items inside a ceiling or crawl space (e.g., insulation) in which the recessed lighting system 1 has been installed and 2) directs light emitted by the light source module 6 along with a trim 2 and/or reflector insert 4 to generate a more focused beam of light. The integrated interface module 5 may be formed of metals, polymers, metal alloys, and/or other heat insulating materials. FIG. 5 shows a cutaway side view of the integrated interface module 5 according to one embodiment. As shown in FIG. 1 and FIG. 5, the integrated interface module 5 may be a cylindrical structure that defines a cavity 17C therein. However, in other embodiments, the integrated interface module 5 may be any suitable shape, including an ellipsoid, cone, or polygon that is capable of housing the light source module 6.

In one embodiment, the integrated interface module 5 may include an open front face 18A and an open rear face 18B. The space between the front and rear faces defines the cavity 17C. Similar to the cavities 17A and 17B, the cavity 17C may be shaped to focus light from the light source module 6, which is situated along the open rear face 18B, toward the open front face 18A and out into a room in which the recessed lighting system 1 is installed via a trim 2, the reflector insert 4, and/or the lens 3. For example, the shape of the cavity 17C may be defined by a frusto conical shaped wall as shown; however, in other embodiments the cavity 17C may be in any other shape that facilitates the focusing of light (e.g., frusto pyramidal). In one embodiment, front surfaces of the walls that define the cavity 17C may be coated with or may include one or more reflecting elements that assist in the adjustment of light emitted by the light source module 6. For example, the walls for the cavity 17C may be coated with a shiny enamel or include one or more mirrors or retroreflectors or a microcellular polyethylene terephthalate (MCPET) material to adjust the focus of light emitted by the light module 6. In other embodiments, the cavity 17C may contain various other optic elements to assist in the focusing of light emitted by the light source module 6.

Figure 6:
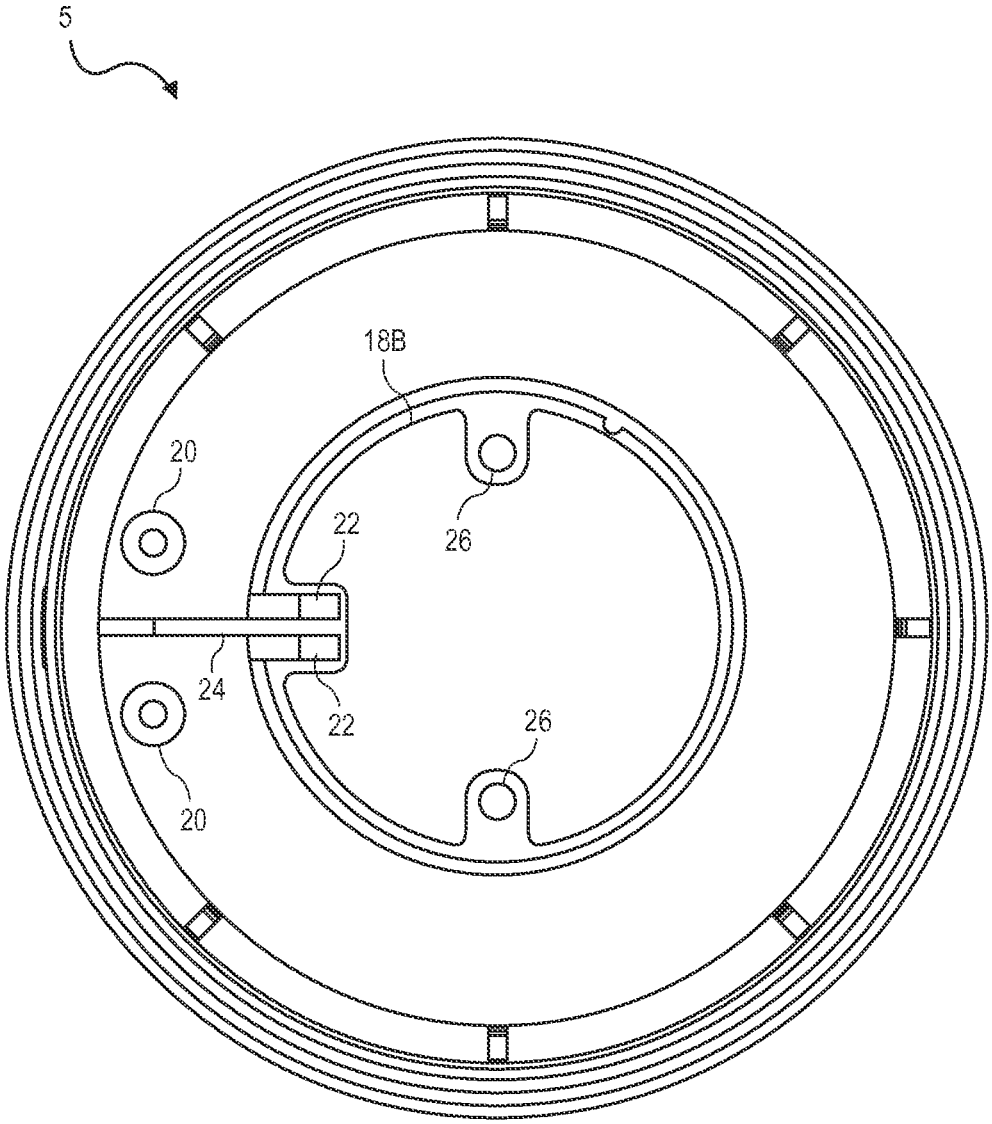
FIG. 6 shows a bottom view of the integrated interface module.

FIG. 6 shows a bottom view of the integrated interface module where the rear face is visible in the drawing. As shown in FIG. 6, in one embodiment, the integrated interface module 5 may include a set of fastener blocks 20 and a set of guides 22 for receiving the electrical contacts 7. The electrical contacts 7 may be each formed of an electrically conductive material that facilitates the transfer of electricity from the power source 12 to the light source module 6. For example, as shown in FIG. 2B and FIG. 7, the electrical contacts 7 may be strips of metal that create an electrical connection between the power source 12 and the light source module 6.

Figure 7:
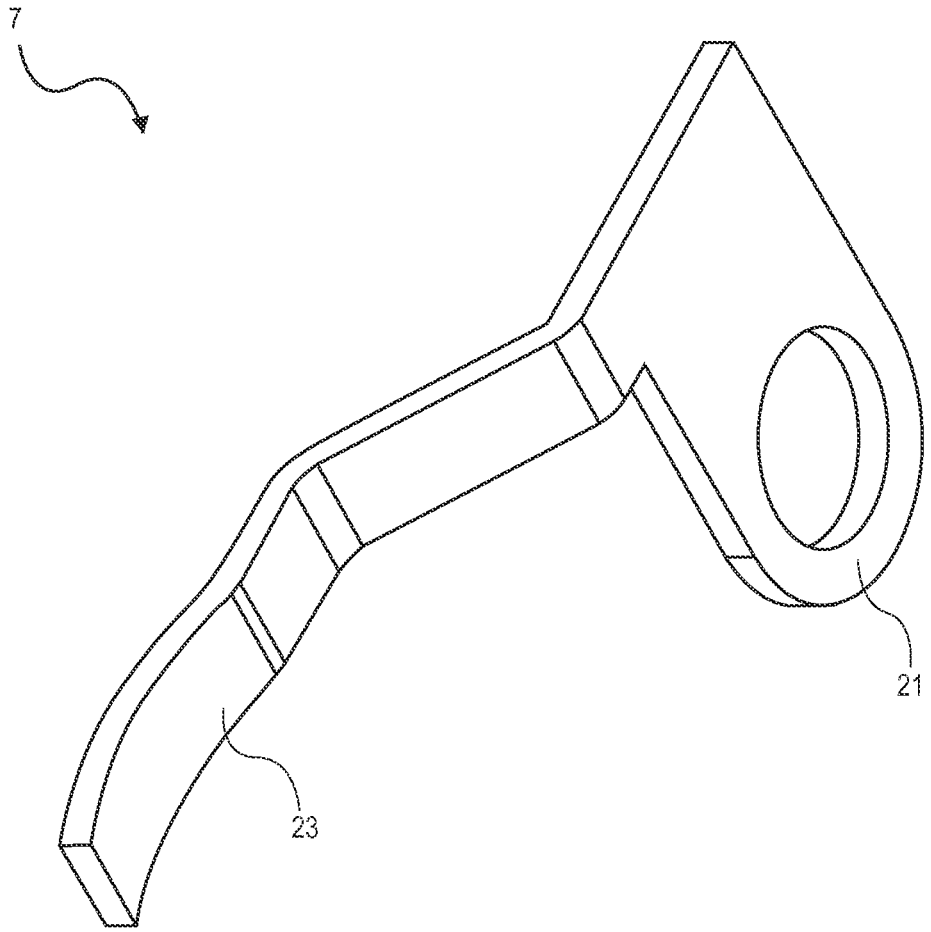
FIG. 7 shows a view of an electrical contact according to one embodiment.

Referring to FIG. 7, in one embodiment, the electrical contacts 7 are each comprised of 1) a base end 21 that may be secured or fastened to the integrated interface module 5 and 2) a finger 23 that simply comes into contact with (to thereby form an electrical connection with) the light source module 6. The finger 23 may be bent relative to the base end 21 such that the finger is raised in relation to the base end 21 and is able to make firm contact with the electrical leads 28 of the light source module 6. As seen in FIG. 6, the fastener blocks 20 may be holes for receiving screws or other fasteners while the guides 22 may be grooves that are sized to receive the fingers 23 of the electrical contacts 7. In this embodiment, the fingers 23 may be narrow tabs that facilitate contact with corresponding leads 28 without contacting other elements of the light source module 6 while the base ends 21 may be wider stubs that facilitate coupling to the fastener blocks 20 of the integrated interface module 5.

In one embodiment, a base end 21 of each of the contacts 7 may be secured to a corresponding fastener block 20 through the use of resins, clips, screws, rivets, or any other fastener. The fastener blocks 20 may also facilitate the connection of corresponding wires that deliver electricity to the contacts 7 from the power source 12. For example, a screw may be used to attach the base end 21 of each contact 7 to the fastener block 20. In this example wires from the power source 12 may be wrapped around each screw. Accordingly, the wires may deliver electricity to the contacts 7 via the connection as the fastener blocks 20.

As described above, the guides 22 may be grooves that are sized to receive the fingers 23 of the electrical contacts 7. Although the contacts 7 may be fastened at the base end 21 to the integrated interface module 5, the fingers 22 may remain unattached from the integrated interface module 5. By being fastened to the integrated interface module 5 at only one end (i.e., the base end 21), the electrical contacts 7 are pivotable/bendable such that a firm but adjustable electrical connection may be established with corresponding electrical leads 28 on the light source module 6. In one embodiment, the guides 22 provide a barrier to prevent the fingers 23 from being overly depressed/bent while in contact with the leads 28 of the light source module 6. Accordingly, the guides 23 ensure that the electrical contacts 7 and the leads 28 maintain a firm connection to facilitate the transfer of electricity between the power source 12 and the light source module 6. Since the electrical contacts 7 only make contact with electrical leads 28 of the light source module 6 instead of a soldered or otherwise more permanent connection, the light source module 6 may be replaced or adjusted within minimal effort.

In one embodiment, a wall 24 may separate a base end 21 and a finger 23 of a first electrical contact 7 from a base end 21 and a finger 23 for a second electrical contact 7. The wall 24 prevents the contacts 7 from coming into contact and causing an electrical short circuit.

In one embodiment, the integrated interface module 5 may include a set of light module mounting blocks 26. The light module mounting blocks 26 may be used for coupling the integrated interface module 5 to the light source module 6 and/or the heat sink 8. For example, the light module mounting blocks 26 may be defined by a set of tabs that include holes for receiving a screw or other fastener. In this embodiment, the light source module 6 and the heat sink 8 may each include a set of holes 29 and 30, respectively, for receiving corresponding screws or fasteners 31. Accordingly, the light source module 6 may be sandwiched between the integrated interface module 5 and the heat sink 8. The fasteners 31 may secure the unified connection between the integrated interface module 5, the light source module 6, and the heat sink 8 using the holes 29 and 30. Although described as holes 29 and 30, the holes 29 and 30 may be replaced with any device or mechanism that allows the coupling of the integrated interface module 5, the light source module 6, and the heat sink 8 as described above. In these embodiments, the fasteners 31 may be clips, screws, bolts, clamps, or any other type of connecting mechanism. By utilizing one set of fasteners (i.e., the fasteners 31) to connect multiple components (i.e., the integrated interface module 5, the light source module 6, and the heat sink 8), the recessed lighting system 1 reduces the number of parts and the overall complexity in comparison to conventional systems.

Figure 8:
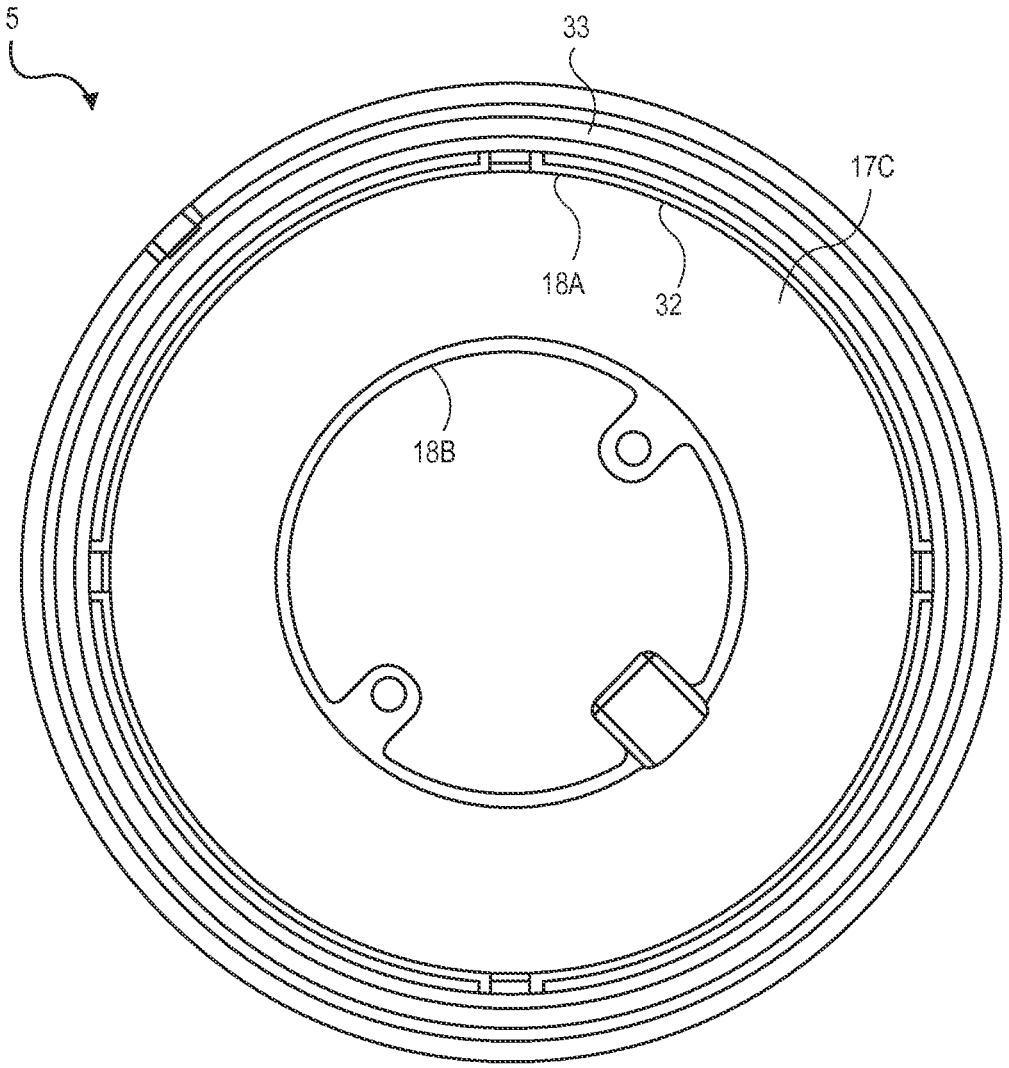
FIG. 8 shows a top view of the integrated interface module.

FIG. 8 shows a top view of the integrated interface module 5 in which the front face 18A of the integrated interface module 5 is pointed outward. In one embodiment, the integrated interface module 5 may include a lip 32 for receiving the lens 3. The lip 32 may be a ridge that surrounds the open front face 18A of the integrated interface module 5. In one embodiment, the diameter/dimensions of the lip 32 are slightly larger (e.g., 1 mm larger) than the diameter/dimensions of the lens 3 and/or the reflector insert 4. By being only slightly larger, the lip 32 allows the lens 3 and/or the reflector insert 4 to tightly/securely fit with the integrated interface module 5. In one embodiment, the lens 3 and/or the reflector insert 4 is fastened to the lip 32 through the use of resins, clips, screws, bolts, clamps, or any other type of connecting mechanism. However, in other embodiments, the lens 3 and/or the reflector insert 4 snap fits into the lip 32 and can be removed by a user without the use of tools. For example, the reflector insert 4 may be placed within the cavity 17C. The lens 3 may thereafter by coupled to the lip 3 such that both the lens 3 and the reflector insert 4 are tightly joined with the integrated interface module 5.

In one embodiment, the integrated interface module 5 may include a channel 33 for receiving a trim 2. The channel 33 may be defined by a set of walls that form a corresponding set of concentric circles with the front face 18A of the integrated interface module 5. In one embodiment, the channel 33 may be sized to receive the ridge 14 of multiple different trims 2. For example, as described above, multiple trims 2 with openings 15A and 15B and flanges 16 of different shapes and sizes may have a uniformly sized and shaped ridge 14. The ridges 14 for each of the trims 2 may fit snuggly into the channel 33 with applied pressure and without the need for tools. Accordingly, trims 2 may be easily coupled to the integrated interface module 5 by forcing the ridge 14 of a trim 2 into the channel 33. Similarly, a trim 2 may be removed by forcing/pulling a corresponding ridge 14 from the channel. As described above, the integrated interface module 5 allows the replacement and adjustment of trims 2 of different shapes and sizes without the use of tools and with minimal effort.

As described above, the recessed lighting system 1 provides a reduced set of components while ensuring adaptability and easy installation into a structure. In particular, by including an integrated interface module 5 that allows the light source module 6, the trim 2, the lens 3, and the heat sink 8 to be easily replaced with minimal tools and minimal fasteners, the recessed lighting system 1 described herein provides a more efficient and user friendly design in comparison to traditional systems.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A compact recessed lighting system, comprising:

a light source module for emitting light;

a set of electrical contacts for contacting electrical leads on the light source module to provide electricity from a power source to the light source module; and an integrated interface module for supporting the set of electrical contacts and the light source module, wherein the electrical contacts are coupled to the integrated interface module such that the electrical contacts apply pressure to the electrical leads of the light source module.

2. The compact recessed lighting system of claim 1, wherein each of the electrical contacts in the set of electrical contacts comprises:

a base end for coupling to the integrated interface module; and a finger for applying pressure to the electrical leads of the light source module, wherein the electrical contacts pass electricity from the power source to the light source module via the electrical leads to power the light source module to emit light.

3. The compact recessed lighting system of claim 2, wherein the integrated interface module comprises:

a set of fastener blocks for receiving corresponding base ends of separate electrical contacts from the set of electrical contacts and coupling the electrical contacts to the integrated interface module; and a set of guides for supporting corresponding fingers of separate electrical contacts from the set of electrical contacts and ensuring the fingers remain in contact with the electrical leads of the light source module.

4. The compact recessed lighting system of claim 1, wherein the integrated interface module comprises:

mounting blocks for supporting the light source module using a set of fasteners.

5. The compact recessed lighting system of claim 4, further comprising:

a heat sink for dissipating heat generated by the light source module, wherein the light source module and the heat sink are jointly coupled to the integrated interface module using the mounting blocks and the set of fasteners such that the light source module is sandwiched between the integrated interface module and the heat sink.

6. The compact recessed lighting system of claim 1, further comprising:

a lens for adjusting light emitted by the light source module.

7. The compact recessed lighting system of claim 6, wherein the integrated interface module comprises:

a lip for receiving the lens, wherein the lip is sized such that the lens maintains a pressure fit connection with the integrated interface module.

8. The compact recessed lighting system of claim 7, wherein the integrated interface module is defined by a frusto conical shape that includes:

an open front face;

an open rear face; and a set of walls connecting the open front face and the open rear face and creating a cavity between the open front face and the open rear face, wherein the light source module is coupled to the open rear face such that light from the light source module is emitted through the cavity and through the open front face.

9. The compact recessed lighting system of claim 8, further comprising:

a reflector insert that is inserted inside the cavity of the integrated interface module, wherein the reflector insert includes 1) an upper opening shaped to at least partially surround the light source module and 2) a lower opening shaped to meet the dimensions of an upper opening of a trim.

10. The compact recessed lighting system of claim 8, wherein the integrated interface module comprises:

a channel for receiving a trim, wherein the channel is defined by a set of concentric walls surrounding the open front face.

11. The compact recessed lighting system of claim 10, further comprising:

one or more trims for focusing light emitted by the light source module and hiding a hole in which the compact recessed lighting system is installed, wherein the trim includes 1) an upper opening surrounded by a ridge for coupling with the channel of the integrated interface module and 2) a lower opening surrounded by a flange for hiding the hole in which the compact recessed lighting system is installed.

12. The compact recessed lighting system of claim 11, wherein the ridge of each of the one or more trims is sized to fit within the channel to create a friction connection between the ridge and the walls of the channel.

13. A compact recessed lighting system, comprising:

a light source module for emitting light;

an integral optical chamber to direct light emitted from the light source module into a room; and a channel for receiving a trim, wherein the channel is defined by a set of concentric walls and the channel is sized to meet the dimensions of a ridge connector surrounding an opening of the trim such that the ridge connector and the channel create a snap connection when the ridge connector is forced inside the channel.

14. The compact recessed lighting system of claim 13, wherein the integral optical chamber comprises:

an open front face, an open rear face, and a set of walls connecting the open front face and the open rear face and creating a cavity between the open front face and the open rear face, wherein 1) the channel is located along the open front face to couple the trim to the open front face and 2) the light source module is coupled to the open rear face such that light from the light source module is emitted through the cavity, through the open front face, and through the trim and into the room.

15. The compact recessed lighting system of claim 14, wherein the integral optical chamber further comprises:

mounting blocks located along the open rear face of the integral optical chamber for supporting the light source module using a set of fasteners.

16. The compact recessed lighting system of claim 14, wherein the integral optical chamber further comprises:

a set of reflecting elements located on the set of walls that assist in the adjustment of light emitted by the light source module.

17. A compact recessed lighting system, comprising:

a light source module for emitting light;

an integrated interface module defining a cavity to direct light emitted from the light source module; and a reflector insert that is inserted inside the cavity of the integrated interface module, wherein the reflector insert includes 1) an upper opening shaped to at least partially surround the light source module and 2) a lower opening shaped to meet the dimensions of an upper opening of a trim.

18. The compact recessed lighting system of claim 17, further comprising:

a lens for adjusting light emitted by the light source module, wherein the integrated interface module includes a lip for receiving the lens and the lip is sized such that the lens maintains a pressure fit connection with the integrated interface module and secures the reflector insert within the cavity of the integrated interface module.

19. The compact recessed lighting system of claim 17, wherein the integrated interface module further includes:

a set of reflecting elements located on walls of the integrated interface module that assist in the adjustment of light emitted by the light source module.

20. The compact recessed lighting system of claim 17, further comprising:

a heat sink for dissipating heat generated by the light source module, wherein the light source module and the heat sink are jointly coupled to the integrated interface module such that the light source module is sandwiched between the integrated interface module and the heat sink.

* * * * *